United States Patent [19]

Wolf

[11] 4,386,548

[45] Jun. 7, 1983

[54] SHOULDER REST FOR A STRING INSTRUMENT

[76] Inventor: Wilhelm Wolf, Zandweg 78, NL-DeMeern (UTR), Netherlands

[21] Appl. No.: 297,131

[22] Filed: Aug. 28, 1981

[30] Foreign Application Priority Data

Apr. 9, 1980 [DE] Fed. Rep. of Germany ..... 3033310

[51] Int. Cl.[3] ..... G10G 5/00

[52] U.S. Cl. ..... 84/280

[58] Field of Search ..... 84/278–280

[56] References Cited

U.S. PATENT DOCUMENTS 3,479,916 11/1969 Wolf ..... 84/280

FOREIGN PATENT DOCUMENTS 2604897 8/1976 Fed. Rep. of Germany ..... 84/280

*Primary Examiner*—Lawrence R. Franklin

*Attorney, Agent, or Firm*—Merchant, Gould, Smith, Edell, Welter & Schmidt

[57] ABSTRACT

A shoulder rest (1) for a string instrument having a support plate (2) including a belt-like strip (7) and a padding plate (6) is disclosed. A support bracket (3) extends along the longitudinal axis of the support plate (2) and is attached at one end (8) to the support plate (2). The other end of the support bracket (3) is connected with the support plate (2) only by means of a spacing adjustment mechanism (21, 22, 23, 24) acting along the longitudinal axis. A height adjustable clamping device (5) is mounted on the fixed end of the support bracket (3), and a second height adjustable clamping device (4) is mounted on the free end of the support bracket (3) by means of a longitudinally extending, sliding support arm (18) telescopically contained within a casing (19).

4 Claims, 1 Drawing Figure

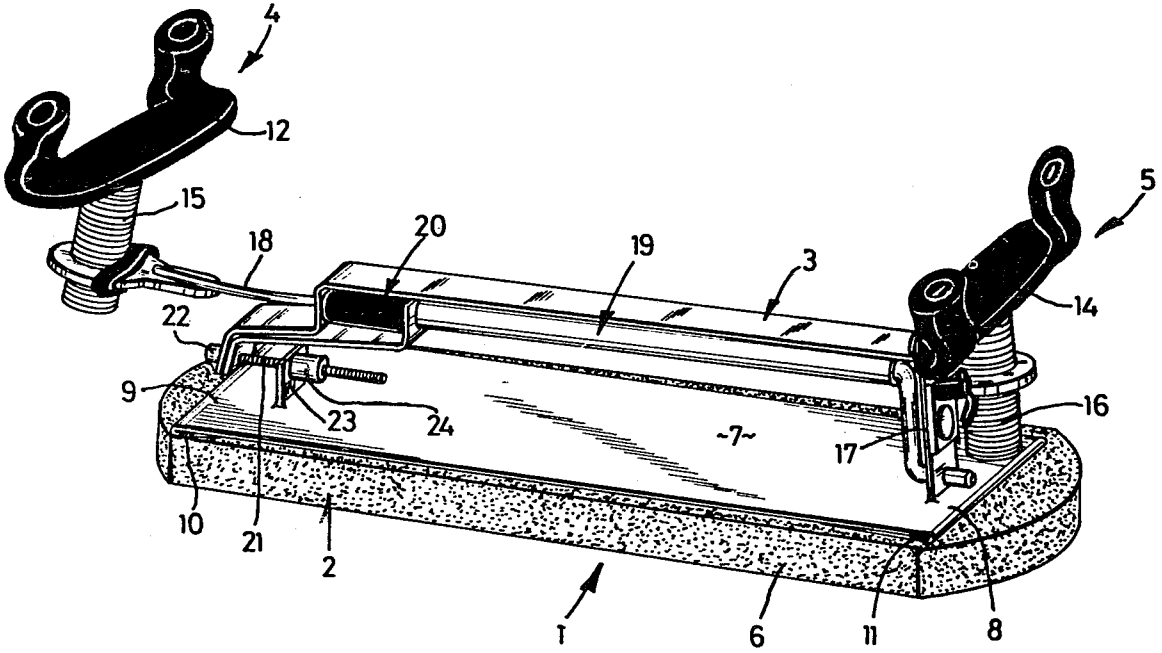
5
14
16
8
11
17
3
6
7
19
1
20
24
23
2
4
12
18
21
15
22
10
9

SHOULDER REST FOR A STRING INSTRUMENT

TECHNICAL FIELD

The invention relates to a shoulder rest for a string instrument and in particular to an improvement in known prior art shoulder rests.

BACKGROUND

A prior art shoulder rest is described in German patent application No. DE-AS 26 04 897 which was published Aug. 19, 1976 by the German Patent Office. This shoulder rest consists essentially of the clamping devices for supporting the string instrument and the support plate itself. The support plate is a two-piece construction displaying on one side a relatively thick padding plate which contacts the person playing the instrument, and on the other side a bearing plate consisting of a thin metal plate that supports on one of its two sides the clamping devices, and is secured on its other side to the padding plate. By bending the thin metal bearing plate, adaptations of the supporting plate to the particular body shape of the person playing the instrument are possible.

However, this type of prior art shoulder rest can only be fitted to a limited extent to the body shape of the person using the instrument, and it enables only a limited extension of one clamping device along the longitudinal axis of the shoulder rest. With such a construction, supporting a viola is not possible.

The problems with the prior art which are overcome by the present invention include increasing the width of adjustment of the clamping devices that hold the instrument itself upon the rest, and allowing adjustment of the flexibility and, in particular, the degree of pliableness of the actual support plate.

SUMMARY

To achieve these objectives, the present invention includes the use of a support bracket which extends along the longitudinal axis, substantially the entire length of the shoulder rest. The support bracket has one end directly attached to the support plate. Its opposite end includes one of two clamping devices which is connected to the support plate only through means of a spacing adjustment mechanism which acts along the longitudinal axis of the shoulder rest.

Therefore, in contrast to the known shoulder rests, one of the clamping devices of the present invention is not supported directly by the support plate itself. Rather, the second clamping device is secured only indirectly to the support plate in the following manner. The support bracket supports at one end a first clamping device. This end of the support bracket is firmly attached to the support plate. The support bracket extends, along the longitudinal axis of the shoulder rest, over substantially the entire length of the shoulder rest. At the free end of the support bracket opposite the fixed end, the second clamping device is mounted and thus is not connected directly with the support plate. The second clamping device is connected with the support plate by a spacing adjustment mechanism which regulates the tension between the support bracket and the support plate. The support bracket has of necessity a stiff construction, e.g. spring steel, and it acts as a tensioning bracket or abutment for generating the tensioning force on the actual support plate. It is advantageous if the support plate is formed of a belt-like strip secured atop the actual padding. Anchoring of the support bracket, on the one hand to the belt-like strip and on the other hand to the spacing adjusting mechanism, is accomplished, in accordance with one form of the embodiment, by bending the belt-like strip around in loop fashion at its two end regions. At each end region a small, spring steel support extends upwardly to support at one end the support bracket, and at the other end of the strip, the spacing adjusting mechanism.

The spacing adjustment mechanism includes an adjustment screw which is braced on one end against the respective upwardly extending support of the support plate and on its other end against the free end of the support bracket. With this arrangement it is possible to adjust the distance between the free end of the support bracket and the upwardly extending support on the support plate by actuating the adjustment screw. In this manner the tension of the belt-like strip may be regulated.

In the preferred embodiment of the present invention the actuating element for the adjustment screw is an internal hex screw head. The actuation may be accomplished easily from the outer side of the shoulder rest and by a lay person using an appropriate, small screw-wrench that is known by those skilled in the art.

With the present invention the displacement of the second clamping device may be executed along the entire longitudinal axis of the shoulder rest, by means of a support arm that extends substantially the entire length of the support bracket and which may be pulled outwardly from the support bracket a width that will enable the invention to support a relatively large string instrument, e.g. a viola.

Moreover, a shoulder rest constructed in accordance with the present invention allows the strength, i.e. the temper, of the support plate comprising the belt-like strip and the layer of padding, to be regulated independently of the width to which the second clamping device has been extended. Additionally, a high capability for movement of the arm, on the shoulder of which the instrument is braced, is now possible. And, at the same time adaptation of the shoulder rest to the individual shape of the person's shoulder is possible.

BRIEF DESCRIPTION OF THE DRAWINGS

The drawing is a view in perspective of the preferred embodiment of the present invention.

DETAILED DESCRIPTION OF THE PREFERRED EMBODIMENT

In the drawing, the numeral 1 designates the shoulder rest of the present invention which consists essentially of a support plate 2, a support bracket 3, and a pair of clamping devices 4 and 5.

The support plate 2 consists of a padding plate 6 and a belt-like strip 7 to which is firmly attached the padding 6, for example, by cementing. The belt-like strip 7 is constructed from a flexible material having a relatively high tensile strength. At each of its two ends 8, 9 the belt-like strip 7 is bent around in a loop-fashion. A small plate 10, 11, constructed preferably from spring steel, is provided at each end 9, 8 respectively to serve as the mounting support for the clamping devices 4, 5.

Each of the clamping devices 4, 5 includes a hold grip 12, 14 respectively, which are each supported in height-adjustable fashion, by threaded rods 15, 16 respectively. This type of hold grip is well known in the prior art.

Means for mounting and supporting the clamping devices 4, 5 includes a support bracket 3. The support bracket 3 is borne directly at one end upon the plate 11 by an upright leg 17 which in turn supports the first clamping device 5. From this end the support bracket bends away, substantially at right angles, and extends along the longitudinal axis of the shoulder rest 1 substantially the full length of the belt-like strip 7 where it terminates in a free end in the region of the oppositely lying end 9 of the belt-like strip 7. At its free end the support bracket 3 supports the second clamping device 4 by means of a support arm 18. The support arm 18 is constructed so that it may be guided inside a tubular casing 19 positioned so as to lie along the longitudinal axis of the shoulder rest. Through means of a self-locking, positioning mechanism 20, known in the art, it is possible to secure, in relatively fixed fashion, the supporting arm 18 in any withdrawn position relative to the casing 19. The supporting arm 18 may be extended outwardly a distance substantially equal to the entire length of the shoulder rest. The arm 18 is securely supported within the tubular casing 19. In this manner a broad span of withdrawal of the clamping device 4 relative to the shoulder rest is possible, so that adaptations, e.g. for a viola, are possible.

The free end of the support bracket 3 also supports an adjustment screw 21 that braces itself against a lip of the support bracket free end by means of an internal hex screw head 22. The adjustment screw extends through the lip and through an upwardly extending abutment 23 borne by plate 10 at a selected distance from the support bracket free end. The attachment of the screw to the abutment 23 is accomplished by means of a component 24 that has a corresponding internal thread which meshes with the thread on the screw 21. It can be appreciated that by actuation of the internal hex screw head 22, a tensioning force can be exerted on the abutment 23 which is transferred by the plate 10 to the belt-like strip 7. The belt-like strip 7 is then stressed correspondingly. With the screw adjustment mechanism different stiffnesses of the belt-like strip 7 can be achieved. Any regulation of the withdrawal of the clamping device 4 with respect to the shoulder rest is independent of the tensioning of the belt-like strip 7.

The support bracket 3 may be constructed of spring steel. The tubular casing may be formed of a light metal or plastic tubing. The padding 6 may consist of a foam substance. The belt-like strip 7 may be manufactured of a textile webbing.

Vertical displacements of the clamping devices 4, 5 as known in the prior art, are possible and thus it is believed unnecessary to explain these displacement capabilities in more detail here.

I claim:

1. A shoulder rest for a string instrument, comprising:

a flexible support plate having a first end and a second end;

a relatively rigid support bracket extending longitudinally on said support plate, said bracket having a first end fixed to said support plate first end and having a second free end;

a first height-adjustable, instrument clamping device mounted on said support bracket first end;

plate tensioning means connecting said support plate second end with said support bracket free end, said tensioning means including an upright member fixed to said support plate adjacent said second end, and adjusting screw means connecting said upright member and said support bracket free end for adjusting the longitudinal distance therebetween;

a support arm extendably connected with said support bracket free end for movement longitudinally of said support bracket, said support arm having a first end external to said support bracket, said support arm being mounted adjacent to but independent of said tensioning means; and a second height-adjustable, instrument clamping device mounted on said support arm external end.

2. A shoulder rest in accordance with claim 1, wherein said support plate includes a flexible belt-like strip made from a material having high-tensile strength and a padding plate secured to said belt-like strip.

3. A shoulder rest in accordance with claim 1 wherein said adjusting screw means includes an adjustment screw braced at one end against said upright member and at an opposite end against said support bracket free end.

4. A shoulder rest in accordance with claim 3 wherein said adjusting screw means includes an internal hex screw head constructed and arranged for actuating said adjustment screw.

* * * * *